US008215038B1

(12) United States Patent
Sattler et al.

(10) Patent No.: US 8,215,038 B1
(45) Date of Patent: Jul. 10, 2012

(54) SPIKE SAVER

(76) Inventors: Dale D. Sattler, Shady Cove, OR (US); JoAnn Sattler, Shady Cove, OR (US)

( * ) Notice: Subject to any disclaimer, the term of this patent is extended or adjusted under 35 U.S.C. 154(b) by 498 days.

(21) Appl. No.: 12/378,111

(22) Filed: Feb. 9, 2009

(51) Int. Cl.
*A43B 5/18* (2006.01)
*A43B 3/12* (2006.01)

(52) U.S. Cl. ..... 36/135; 36/11.5; 36/7.5

(58) Field of Classification Search ..... 36/11.5, 36/135, 7.3–7.7; D2/916
See application file for complete search history.

(56) References Cited

U.S. PATENT DOCUMENTS

| | | | | |
|---|---|---|---|---|
| 4,461,100 | A * | 7/1984 | Minor et al. | 36/72 B |
| 4,484,398 | A | 11/1984 | Goodwin et al. | |
| 5,070,631 | A | 12/1991 | Fenton | |
| D348,763 | S * | 7/1994 | Judd et al. | D2/916 |
| 5,548,910 | A | 8/1996 | Klingesis | |
| D411,240 | S * | 6/1999 | Risko | D2/916 |
| 7,694,436 | B2 * | 4/2010 | Mullen | 36/11.5 |

* cited by examiner

*Primary Examiner* — Ted Kavanaugh
(74) *Attorney, Agent, or Firm* — Jerry Haynes Law

(57) ABSTRACT

A spike saver for attachment for protecting a spike-bearing shoe that includes a sole for protecting the bottom of the spike-bearing shoes and with two double legged elastic straps attached to the sole at each side for releasably holding the spike-bearing shoes by means of hook and loop arrangement.

9 Claims, 1 Drawing Sheet

SPIKE SAVER

BACKGROUND OF THE INVENTION

1. Field of the Invention

The present invention relates to a shoe protection device, and more particularly, to a spike saver for protecting the structural integrity of track shoe spikes and the spikes of other spike-bearing shoes. The spike saver is a light weight sandal having side elastic straps with a hook and loop arrangement for attachment to a spike-bearing shoe for protection from damage while walking and thus enhancing the life of a spike-bearing shoe.

2. Description of the Related Art

Spiked shoe protectors have been generally known in the art for saving track shoes with spikes, golf shoes having spikes, and shoes having cleats. Shoe savers protect surfaces and floors from damage while the wearer of the shoes walks over such surfaces. Shoe savers also protect the shoe itself from structural damage. In an effort to overcome aforementioned problems, the following patent documents disclose examples of existing shoe protection devices.

U.S. Pat. No. 4,484,398 issued to Goodwin et al, Nov. 27, 1984, outlines a spike shoe protector formed of a sole having transversely spaced channels for enclosing the spikes within with side flaps attached to the shoe by releasable gripping elements.

U.S. Pat. No. 5,070,631 issued to Fenton, on Dec. 10, 1991, discloses a golf shoe cleat cover having grooves located on the underside of the cover with a plurality of cleat gripping members slideably postionable within the groove to conform to the pattern and spacing of the cleats on a golf shoe.

U.S. Pat. No. 5,548,910 issued to Klingseis, on Aug. 27, 1996, outlines a spike guard in the shape of a shoe insert to be worn on the underside of a track shoe having a sole with a toe and a heel receiving pockets to hold the track shoe in position with elastomeric projections provided on the top of the sole for containing the spikes within.

Various devices have been developed in the past which provide protection to the track shoes and other shoes having spikes and cleats. None of the above discussed patent documents, taken either singularly or in combination, however, describes the instant invention which is specifically designed to provide protection to spike-bearing shoes. Thus a simple, easy to use, affordable, and effective spike saver solving the aforementioned problems which maintains an overall structural integrity of spike-bearing shoes, while walking on hard surfaces, is desired.

SUMMARY OF THE INVENTION

In accordance with the present invention, a spike saver is used for protecting and for prolonging the life of spike-bearing shoes. Track shoes are spike-bearing shoes used at most track and field events. They are lightweight shoes with spikes screwed into their bottom, or spike plate, in order to maximize traction (and therefore performance) when running, throwing, or jumping. In order to maintain the structural integrity of the track shoes and for protecting the floor and surrounding stadium environment while walking on them. The spike saver of the instant invention includes a sole for protecting the bottom of the spike-bearing shoes and with two double legged elastic straps attached to the sole at each side for releasably holding the spike-bearing shoes by means of hook and loop arrangement.

Accordingly, it is a principal object of the invention to provide a spike saver device which is easy to use, inexpensive, dependable, and fully effective in accomplishing its intended purposes.

It is another object of the invention that spike saver is readily adjustable to accommodate a wide variety of spike-bearing shoes which can be quickly and easily applied or removed, yet which, when applied, provides full and complete protection against marring, scratching, slipping and other hazards resulting while wearing track spike shoes for walking on floors or rough surfaces.

It is a further object of the invention to construct the body of the spikes saver comprising a sole of foam made of dense rubber for covering the bottom of a spike-bearing shoes and a double legged elastic straps attached at each side of the sole are made of resiliently stretchable material in order to hold various sizes of spike-bearing shoes to be protected.

The summary of the present invention will become readily apparent upon further review of the following specifications and drawings.

BRIEF DESCRIPTIONS OF THE DRAWINGS

DETAILED DESCRIPTION OF THE PREFERRED EMBODIMENTS

Figure 1:
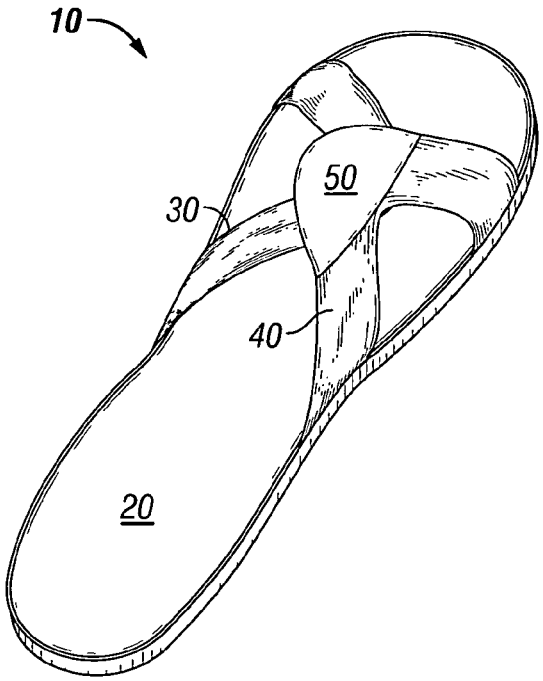
FIG. 1 illustrates a perspective view of a spike saver according to the present invention.
Figure 2:
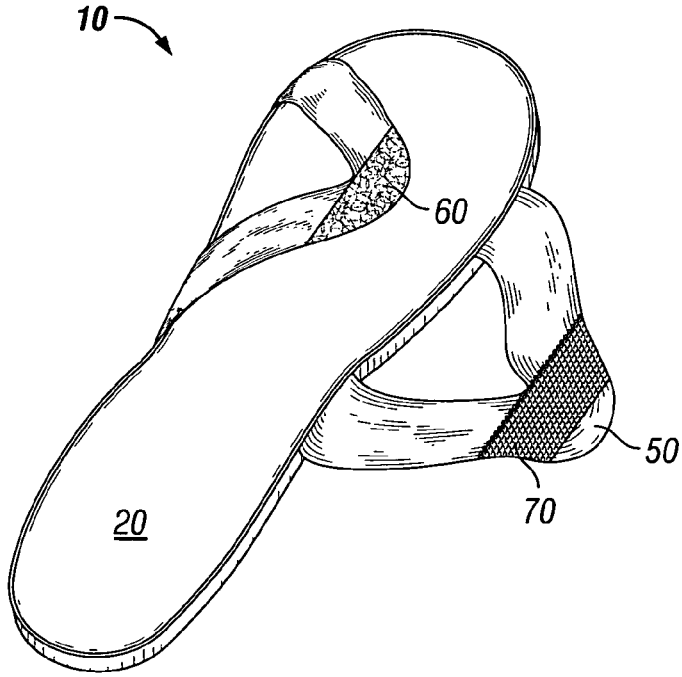
FIG. 2 illustrates a perspective view of the spike saver showing open flaps and the positioning of a hook and loop fastening device.

The present invention is a spike saver device, designated as 10 in drawings, as illustrated in FIGS. 1 and 2. Spike saver 10 includes a sole 20, which is designed to cover the bottom of a spike-bearing shoe. The sole 20 is formed of a foam material, consists of dense rubber and double legged elastic straps 30, 40 having spread apart legs at one end and an apex at the other end. The double legged elastic straps include a hook and loop fastening means 60, 70 located at the apex for releasably holding the track shoe within. The double legged elastic straps are formed of resiliently stretchable material which can be stretched to hold various sizes of spike-bearing shoes within. The apex of the double legged elastic strap additionally includes a pull tab 50 for releasably engaging and disengaging the elastic straps 30, 40 together by hook and loop fastening elements 60, 70 located at the apex.

In order to install the spike saver 10 on a spike-bearing shoe, the sole 20 is placed under the track shoe having spikes to be protected in such a manner that the spikes on the track shoe are covered by the sole 20. A pair of elastic straps 30, 40 attached on each side of the sole are snapped together with the respective gripping elements 60, 70 for releasably holding the shoe in position and additionally a pull tab 50 is provided at the apex of one of the elastic strap for engaging and disengaging the gripping elements 60, 70 when desired to hold or release the track spikes shoe within.

Although the invention has been described in detail with reference to the presently preferred embodiments, those of ordinary skill in the art will appreciate the various alterations, modifications and improvements thereto will readily occur. Accordingly, the foregoing description is by way of example only and the invention is to be limited by the following claims and equivalents thereto.

We claim:

1. A spike saver for attachment to a spike-bearing shoe for protection, comprising:

a generally elongated sole having a first end, a second end and sides;

at least two double legged elastic straps, each strap comprises a single, continuous, structure forming a V-shape figure having a generally curved or semicircular apex at one end and two spread apart legs at the other end adapted for attachment to one of the side of the elongated sole and each strap is wider along a longitudinal axis of the elongated sole than along a transverse axis of the elongated sole;

a fastening means disposed inside of the apex of one of the double legged elastic strap and a complementary fastening means disposed outside of the apex of the other double legged elastic strap;

a pull tab is located at the apex of one of the double legged elastic strap, whereby the elongated sole being adapted to cover the bottom of the shoe having spikes and two V-shaped legs of the elastic straps attached to the sides of the elongated sole, one leg at about a front of the sole and the other leg at about middle of the sole for holding a shoe spikes within by releasably engaging the fastening means together at the apex by pulling the pull tab thereof; and whereby each double legged elastic strap is coextensive with approximately a front half of the elongated sole.

2. A spike saver of claim 1, wherein one of the legs of the double legged elastic strap is attached near the toe portion of the sole designed to provide support to the front of the shoe and the other leg is attached to about the middle of the sole for providing support to the rear of the shoe.

3. A spike saver of claim 1, wherein the pull tab located at the apex of the one of the elastic strap designed and adapted for releasably engaging and disengaging the elastic straps at fastening means.

4. A spike saver of claim 3, wherein the fastening means are hook and loop.

5. A spike saver of claim 3, wherein the fastening means are hook and loop fastening means.

6. A spike saver of claim 1, wherein the sole comprises a foam material made of dense rubber.

7. A spike saver of claim 1, wherein the V-shaped legs of the double legged elastic strap are more stretchable compared to the apex portion having a pull tab, designed and adapted to hold various sizes of a shoe within.

8. A spike saver of claim 7, wherein the elastic straps are made of resiliently stretchable material.

9. A spike saver of claim 1, wherein the apex of one of the elastic strap comprises a fastening means, such as a loop and the other complementary fastening means, such hook and the hook fastening means also includes a pull tab for engaging and disengaging the elastic straps.

* * * * *